US008489009B2

(12) United States Patent
Seki

(10) Patent No.: US 8,489,009 B2
(45) Date of Patent: Jul. 16, 2013

(54) FIXING DEVICE AND IMAGE FORMING APPARATUS INCLUDING SAME

(75) Inventor: Takayuki Seki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 272 days.

(21) Appl. No.: 12/964,030

(22) Filed: Dec. 9, 2010

(65) Prior Publication Data

US 2011/0188907 A1 Aug. 4, 2011

(30) Foreign Application Priority Data

Jan. 29, 2010 (JP) ..... 2010-017700
Mar. 26, 2010 (JP) ..... 2010-071687

(51) Int. Cl.
*G03G 15/20* (2006.01)
*H05B 11/00* (2006.01)

(52) U.S. Cl.
USPC ..... 399/329; 399/122; 399/320; 219/216

(58) Field of Classification Search
USPC ..... 399/122, 320, 329; 219/216
See application file for complete search history.

(56) References Cited

U.S. PATENT DOCUMENTS 5,625,442 A 4/1997 Seki
5,666,624 A * 9/1997 Kanesawa et al. ..... 399/329
5,749,037 A 5/1998 Takayuki
5,832,354 A 11/1998 Kouno et al.
5,915,147 A 6/1999 Kouno et al.
5,970,298 A 10/1999 Seki et al.
6,305,636 B1 10/2001 Satoh et al.
6,694,121 B2 2/2004 Seki
6,795,678 B2 * 9/2004 Yura et al. ..... 399/329
7,962,083 B2 * 6/2011 Takahashi ..... 399/329
2004/0057759 A1 * 3/2004 Ogiso et al. ..... 399/329
2008/0240809 A1 * 10/2008 Takahashi ..... 399/329
2010/0067929 A1 3/2010 Seki

FOREIGN PATENT DOCUMENTS

JP 04362983 A * 12/1992
JP 10-213984 8/1998
JP 11-219052 8/1999
JP 2001-228734 8/2001
JP 2004-258484 9/2004
JP 2005-266716 9/2005
JP 3753223 12/2005
JP 2006-243497 9/2006
JP 2007-171694 7/2007
JP 4106971 4/2008
JP 2008-197317 8/2008
JP 4178939 9/2008

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A fixing device includes an endless belt-shaped fixing member, a rotary pressing member disposed opposite the fixing member, a stationary member, a friction reducer, and a activation device. The endless belt-shaped fixing member formed in a loop moves in a predetermined direction and fixes a toner image on a recording medium by heating and fusing the toner image. The stationary member is provided inside the loop and pressed against the rotary pressing member through the fixing member to form a nip between the rotary pressing member and the fixing member through which the recording medium bearing the toner image passes. The friction reducer disposed between the fixing member and the stationary member reduces friction generated therebetween. The activation device provided inside the loop of the fixing member moves the friction reducer to change a portion of the friction reducer that comes between the fixing member and the stationary member.

19 Claims, 3 Drawing Sheets

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2010-017700, filed on Jan. 29, 2010, and 2010-071687, filed on Mar. 26, 2010, both in the Japan Patent Office, which are hereby incorporated herein by reference in its entirety.

BACKGROUND OF THE INVENTION

1. Field of the Invention

Exemplary aspects of the present invention generally relate to a fixing device and an image forming apparatus such as a copier, a facsimile machine, a printer, or a multi-functional system including a combination thereof, and more particularly, to a fixing device using a belt-type fixing member and/or a belt-type pressing member, and an image forming apparatus including the fixing device.

2. Description of the Background Art

Related-art image forming apparatuses, such as copiers, facsimile machines, printers, or multi-functional systems having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The fixing device used in such image forming apparatuses may include an endless belt-shaped fixing member or fixing film formed into a loop, a pressure roller serving as a rotary pressing member disposed opposite the fixing belt loop, a stationary member serving as a pressure support member disposed inside the fixing belt loop, a heater (i.e., a halogen lamp) disposed also inside the fixing belt loop, and so forth.

The stationary member contacts and presses the fixing belt against the pressure roller from the inside of the belt loop, thereby defining a nip between the fixing belt and the pressure roller. The fixing belt is heated by the heater disposed inside the loop. As the recording medium bearing the toner image passes through the nip, heat and pressure are applied to the toner image, thereby fixing the toner image onto the recording medium.

In order to reduce friction between the fixing belt and the stationary member in a known fixing device, typically, a lubricating agent is supplied between the fixing belt and the stationary member, or contact surfaces of both the fixing belt and the stationary member are made of low-friction material.

Alternatively, a low-friction slip is provided between the fixing belt and the stationary member.

Although advantageous, the lubricating agent supplied between the fixing belt and the stationary member is exhausted or seeps out over time, resulting in wearing out of the contact surfaces of the fixing belt and the stationary member. In the case of the contact surfaces of the fixing belt and the stationary member made of low-friction material or providing the low-friction slip between the fixing belt and the stationary member, repeated sliding movement over time wears out the contact surfaces of the fixing belt and the stationary member, or the low-friction slip, thereby increasing friction.

An increase in the friction between the fixing belt and the stationary member causes various problems, such as an increase in a drive torque needed for driving these parts, abrasion of the fixing belt and the stationary member, and drifting of the fixing belt which causes image misalignment. These problems are also common in a known fixing device using the stationary member pressing a rotary fixing member through a belt-type pressure member.

In view of the above, there is demand for a device capable of maintaining low friction between a belt member, such as a fixing belt and a pressure belt, and a stationary member slidably contacting the belt member for an extended period of time.

SUMMARY OF THE INVENTION

In view of the foregoing, in one illustrative embodiment of the present invention, a fixing device includes an endless belt-shaped fixing member, a rotary pressing member, a stationary member, a friction reducer, and an activation device. The endless belt-shaped fixing member formed in a loop moves in a predetermined direction and fixes a toner image on a recording medium by heating and fusing the toner image. The rotary pressing member is disposed opposite the fixing member. The stationary member is provided inside the loop formed by the fixing member and is pressed against the rotary pressing member through the fixing member to form a nip between the rotary pressing member and the fixing member through which the recording medium bearing the toner image passes. The friction reducer is disposed between the fixing member and the stationary member, to reduce friction generated therebetween. The activation device provided inside the loop of the fixing member moves the friction reducer to change a portion of the friction reducer that comes between the fixing member and the stationary member.

In another illustrative embodiment of the present invention, a fixing device includes a rotary fixing member, an endless belt-shaped pressure member, a stationary member, a friction reducer, and an activation device. The rotary fixing member heats and fuses a toner image onto a recording medium to fix the toner image thereon. The endless belt-shaped pressure member is disposed opposite the fixing member and formed in a loop to move in a predetermined direction. The stationary member is provided inside the loop formed by the pressure member and is pressed against the rotary fixing member through the pressure member to form a nip between the pressure member and the rotary fixing member through which the recording medium bearing the toner image passes. The friction reducer is sandwiched between the pressure member and the stationary member, to reduce friction generated therebetween. The activation device moves the friction reducer to change a portion of the friction reducer that comes between the pressure belt and the stationary member.

In yet another illustrative embodiment of the present invention, an image forming apparatus includes a fixing device.

The fixing device includes an endless belt-shaped fixing member, a rotary pressing member, a stationary member, a friction reducer, and an activation device. The endless belt-shaped fixing member formed in a loop moves in a predetermined direction and fixes a toner image on a recording medium by heating and fusing the toner image. The rotary pressing member is disposed opposite the fixing member. The stationary member is provided inside the loop formed by the fixing member and is pressed against the rotary pressing member through the fixing member to form a nip between the rotary pressing member and the fixing member through which the recording medium bearing the toner image passes. The friction reducer is disposed between the fixing member and the stationary member, to reduce friction generated therebetween. The activation device provided inside the loop of the fixing member moves the friction reducer to change a portion of the friction reducer that comes between the fixing member and the stationary member.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
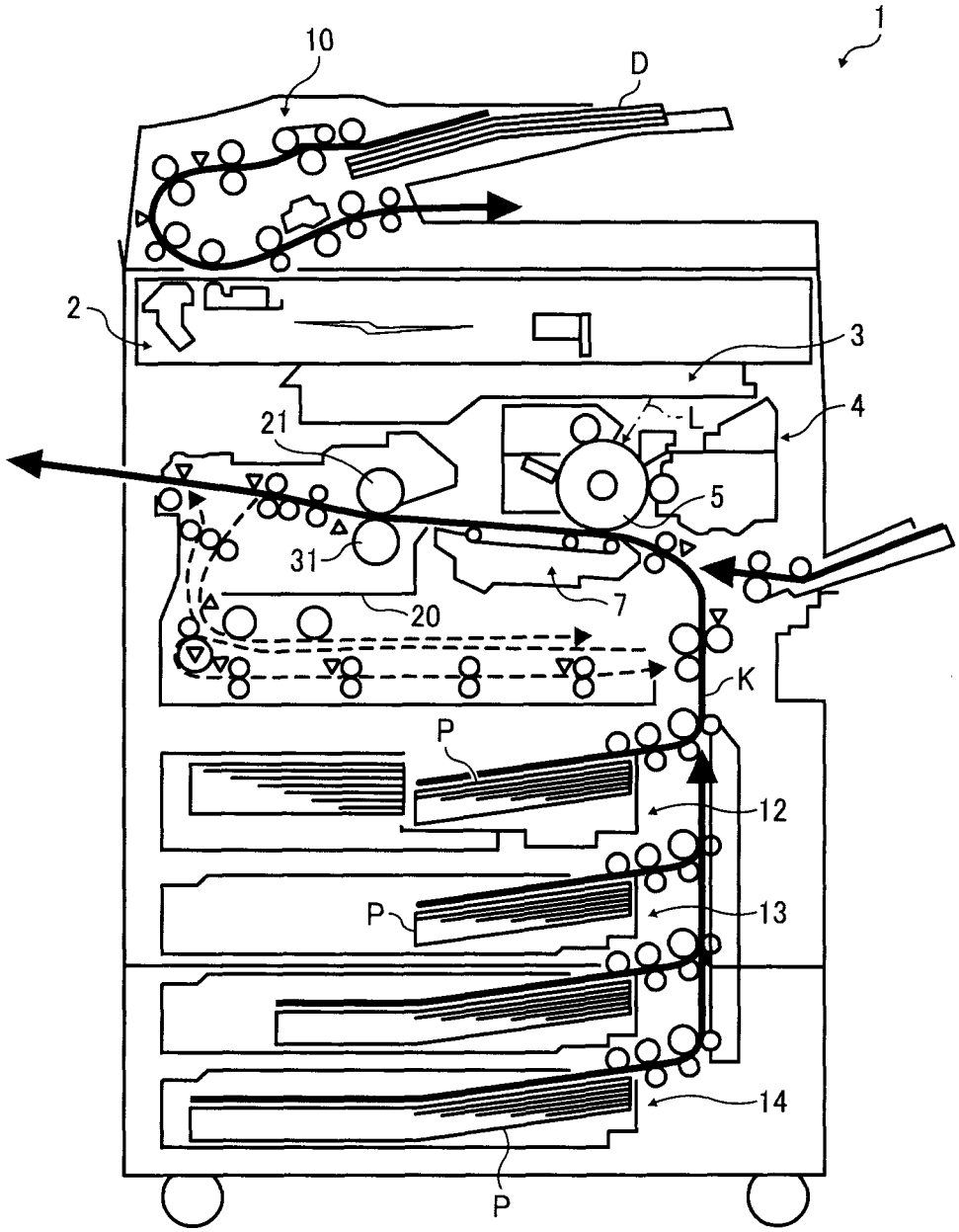
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, a paper feeder, etc., it should be understood that the sheets, etc., are not limited only to paper, but include other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an image forming apparatus. With reference to FIG. 1, a configuration and operation of the image forming apparatus is described.

In FIG. 1, the image forming apparatus includes a main body 1 having a copying function, a document reading unit 2, an exposure device 3, an image forming unit 4, a transfer device 7, a document conveyance unit 10, sheet cassettes 12, 13, and 14, and a fixing device 20.

The document reading unit 2 optically reads image information of an original document D. The exposure device 3 illuminates a photoconductive drum 5 of the image forming unit 4 with exposure light L based on the image information of the original document D. The image forming unit 4 forms a toner image on the photoconductive drum 5. The transfer device 7 transfers the toner image from the photoconductive drum 5 onto a recording medium P. The document conveyance unit 10 conveys the original document D set in the document conveyance unit 10 to the document reading unit 2. The sheet cassettes 12, 13, and 14 store multiple recording media sheets. The fixing device 20 fixes the toner image, that is, an unfixed image, on the recording medium P.

The fixing device 20 includes a fixing film 21 and a pressure roller 31 serving as a rotary pressing member.

In the image forming apparatus shown in FIG. 1, the original document D is conveyed from a document table by conveyance rollers of the document conveyance unit 10 in the direction indicated by an arrow, passing substantially above the document reading unit 2. The document reading unit 2 reads optically the image information of the original document D passing above the document reading unit 2. The image information read optically by the document reading unit 2 is converted into electrical signals and transmitted to the exposure device 3 serving as an optical writer. The exposure device 3 illuminates the photoconductive drum 5 of the image forming unit 4 with the exposure light L such as a laser beam or the like based on the electrical signals representing the image information.

In the image forming unit 4, the photoconductive drum 5 is rotated in a clockwise direction in FIG. 1. After imaging processes such as a charging process, an exposure process, and a development process, an image (toner image) corresponding to the image information is formed on the photoconductive drum 5. Subsequently, in the transfer device 7, the toner image formed on the photoconductive drum 5 is transferred onto the recording medium P conveyed by registration rollers.

The recording medium P conveyed to the transfer device 7 is fed from one of the sheet cassettes 12, 13, and 14 of the main body 1. One of the sheet cassettes 12, 13, and 14 is selected either automatically or manually. For example, when the sheet cassette 12 which is the uppermost sheet cassette is selected, the top sheet of the recording media sheets stored in the sheet cassette 12 is conveyed to a sheet conveyance path K.

Subsequently, the recording medium P arrives at the registration rollers after passing through the sheet conveyance path K. The recording medium P is temporality stopped by the registration rollers, and conveyed again to the transfer unit 7 with an appropriate timing such that the recording medium is aligned with the image on the photoconductive drum 5.

After the transfer process, that is, after the recording medium P passes through the transfer device 7, the recording medium arrives at the fixing device 20 through the sheet conveyance path. Arriving at the fixing device 20, the recording medium P is conveyed in a fixing nip where the fixing belt 21 and the pressure roller 31 meet and press against each other. In the fixing nip, heat supplied by the fixing belt 21 and pressure supplied by both the fixing belt 21 and the pressure roller 31 fix the toner image on the recording medium P. After the toner image is fixed, the recording medium exits the fixing nip between the fixing belt 21 and the pressure roller 31, and is discharged from the main body of the image forming apparatus, thereby finishing a series of the image forming process.

Figure 2:
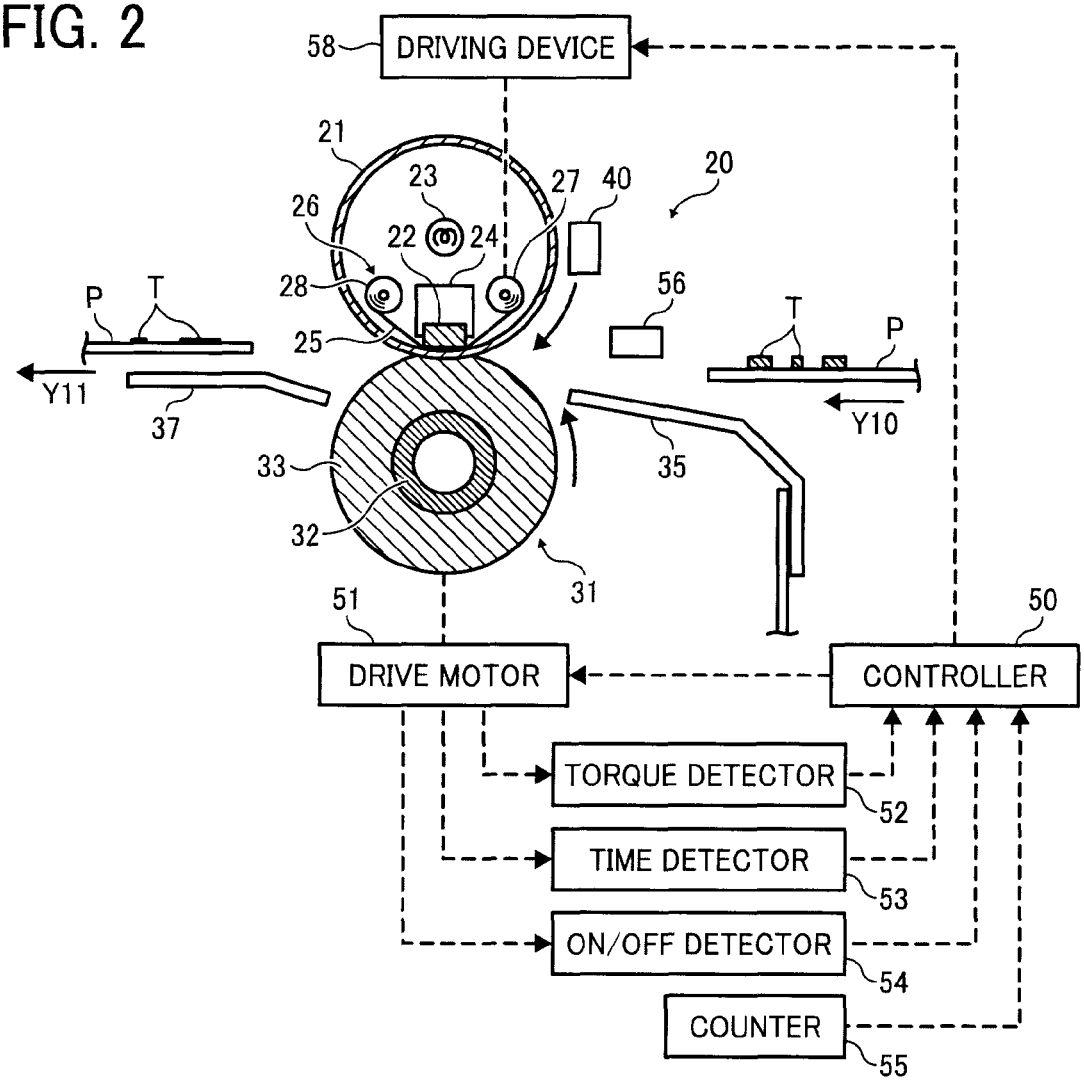
FIG. 2 is a schematic block diagram illustrating a fixing device employed in the image forming apparatus of FIG. 1 according to a first illustrative embodiment of the present invention.

Referring now to FIG. 2, a configuration and operation of the fixing device 20 disposed in the main body 1 is described. FIG. 2 is a schematic block diagram illustrating the fixing device 20, according to a first illustrative embodiment of the present invention. As illustrated in FIG. 2, the fixing device 20 includes the fixing belt 21, a stationary member 22 (a biasing member), a heater 23 serving as a heating member, a holding member 24, the pressure roller 31 serving as a rotary pressing member, a friction reducer 25 that is a sliding member, a reel mechanism 26 serving as a activation device, a temperature detector 40 (for example, a thermopile), guide plates 35 and 37, and so forth.

The fixing belt 21 is a thin and flexible endless belt formed into a loop that moves in a clockwise direction indicated by an arrow in FIG. 2. The fixing belt 21 has a multi-layer structure including a base layer, an intermediate elastic layer disposed on the base layer, and a surface releasing layer disposed on the intermediate elastic.

As a fixing member, the fixing belt 21 having a low heat capacity is used so that a rise time can be shortened significantly. Using a fixing belt with a low heat capacity, it is possible to provide an on-demand fixing device with a short rise time.

The base layer of the fixing belt 21 is formed of, for example, a metal such as nickel and stainless steel, and heat-resistant resin material including, but not limited to, polyimide, polyamide, and polyamideimide.

The elastic layer of the fixing belt 21 includes a rubber material such as silicon rubber, silicon rubber foam, and/or fluorocarbon rubber. The elastic layer prevents or reduces the effects of slight surface asperities of the fixing belt 21 in the nip N between the fixing belt 21 and the pressure roller 31. Accordingly, heat is uniformly transmitted from the fixing belt 21 to a toner image T on a recording medium P, suppressing formation of defective rough images with the appearance of an orange peel.

The releasing layer of the fixing belt 21 includes, but is not limited to, tetrafluoroethylene-perfluoroalkylvinylether copolymer (PFA), polytetrafluoroethylene (PTFE), polyimide, polyetherimide, and polyether sulfide (PES). The releasing layer releases or separates the toner image T from the fixing belt 21.

In the inner loop (on the inner circumference side) of the fixing belt 21 includes the heater 23, the stationary member 22, the holding member 24, the friction reducer 25, the reel mechanism 26, and so forth. The fixing belt 21 is pressed by the stationary member 22 held by the holding member 24 against the pressure roller 31.

The stationary member 22 is formed of, for example, metal, ceramic, or polyimide resin, and held by the holding member 24. The stationary member 22 presses against the pressure roller 31 through the fixing belt 21, thereby forming the nip between the fixing belt 21 and the pressure roller 31.

According to the first illustrative embodiment, the surface of the stationary member 22 facing the pressure roller 31 has a planar shape, thereby making the shape of the nip substantially flat and parallel relative to an image side of the recording medium P. Accordingly, the fixing belt 21 pressed by the planar portion of the stationary member 26 can contact the recording medium reliably, thereby enhancing fixing properties. Moreover, with this configuration, cockling and/or curling of the recording medium P is reduced, if not prevented entirely, as the recording medium passes through the nip. Still further, an increased curvature of the fixing belt 21 at the nip end facilitates separation of the recording medium P discharged from the nip N from the fixing belt 21 as the recording medium P passes through the nip.

According to the illustrative embodiment, the friction reducer 25 is provided between the fixing belt 21 and the stationary member 22 to reduce frictional resistance of both the fixing belt 21 and the stationary member 22. The friction reducer 25 is formed of material having a web-like structure including, but not limited to, a heat-resistant resin nonwoven fabric, a heat-resistant resin film, a liquid crystal polymer sheet, a liquid crystal polymer film, a porous resin nonwoven fabric, a porous resin film, and fiberglass. The low-friction member 25 is movable by winding movement of the reel mechanism 26 serving as a moving member, and a detailed description thereof is provided later.

According to the illustrative embodiment, providing the friction reducer 25 between the fixing belt 21 and the stationary member 22 reduces frictional resistance between the fixing belt 21 and the stationary member 22. To enhance the performance of the friction reducer 25 further, a lubricating agent such as silicone oil and fluorine grease may be impregnated in the friction reducer 25. Alternatively, the surfaces of the stationary member 22 and the fixing belt 21 that slidably contact the friction reducer 25 may be coated with low-friction material such as fluorocarbon resin or the like.

The heater 23 is, for example, a carbon heater or a halogen heater, and both ends thereof are fixed to side plates, not illustrated, of the fixing device 20. The heater 23 is controlled by a power source of the main body 1 to heat the fixing belt 21. The toner image T on the recording medium P is heated by the surface of the fixing belt 21. The temperature of the heater 23 is adjusted based on detection results of the temperature detector 40 (i.e. thermopile) disposed facing the surface of the fixing belt 21. The temperature of the fixing belt 21, that is, the fixation temperature for the toner image T is adjusted to a desired temperature by the heater 23.

Although not illustrated, compression springs are provided at both ends of the holding member 24 in the width direction, thereby biasing the stationary member 22 against the pressure roller 31 and thus forming a desired nip.

The pressure roller 31 is rotatably disposed at the side plate (fixing position) of the fixing device 20 through a shaft bearing. The pressure roller 31 is rotatably driven in a predetermined direction by a drive motor 51, generating frictional force between the fixing belt 21 and the pressure roller 31, thereby enabling the fixing belt 21 to rotate in the direction indicated by an arrow in FIG. 2.

The pressure roller 31 serving as a rotary pressing member includes a metal core 32 on which an elastic layer 33 is provided. The elastic layer 33 includes silicon rubber foam, silicon rubber, and/or fluorocarbon rubber. A thin releasing layer (tube) including PFA or the like may be provided on the elastic layer 33. The pressure roller 31 is pressed against the fixing belt 21 to form the desired nip N between the pressure roller 31 and the fixing belt 21. The pressure roller 31 is driven to rotate by the drive motor 51 in the direction indicated by an arrow, that is, the counterclockwise direction in FIG. 2.

The guide plate 35 is provided substantially at the beginning of the nip where the fixing belt 21 and the pressure roller 31 contact each other. The guide plate 35 guides the recording medium P being conveyed toward the nip. At the other end of the nip, the guide plate 37 is provided to guide the recording medium being discharged from the nip. Both the guide plates 35 and 37 are fixed to a housing or a frame of the fixing device 20.

A description is now provided of operation of the fixing device 20. As the apparatus is activated, power is supplied to the heater 23 and the pressure roller 31 starts to rotate in the direction of arrow in FIG. 2. The frictional force generated between the pressure roller 31 and the fixing belt 21 enables the fixing belt 21 to rotate in the direction of arrow. Subsequently, the recording medium P is fed from one of the sheet cassettes 12, 13, and 14 to the image forming unit 4. In the image forming unit 4, the unfixed toner image T is formed on the recording medium P.

Subsequently, the recording medium P bearing the toner image T is guided to the nip between the fixing belt 21 and the pressure roller 31 by guide plate 35. The recording medium P is heated by the fixing belt 21 heated by the heater 23 upstream from the nip and pressed by the stationary member 22 (the pressure belt 21). Accordingly, the toner image T on the recording medium P is fixed. After that, the recording medium P exits from the nip and is conveyed in the direction indicated by an arrow Y11.

Embodiment 1

With reference to FIG. 2, a description is provided of the fixing device 20 according to a first illustrative embodiment. According to the present embodiment, in the inner loop of the fixing belt 21 of the fixing device 20, the friction reducer 25 serving as a sliding member is provided between the fixing belt 21 and the stationary member 22 to reduce frictional resistance of the fixing belt 21 and the stationary member 22. The friction reducer 25 moves as the reel mechanism 26 serving as a moving mechanism winds the friction reducer 25.

As described above, the friction reducer 25 has a web-like structure. In order to wind around the reel mechanism 26, the friction reducer 25 is long in the direction perpendicular to a width direction which corresponds to a direction perpendicular to a sheet plane of FIG. 2.

The reel mechanism 26 includes a take-up reel 27, a supply reel 28, a driving device 58, and so forth. At the initial use of the supply reel 28, an end of the friction reducer 25 is connected to the supply reel 28 and the friction reducer 25 is wound around the supply reel 28. By contrast, the other end of the friction reducer 25, that is, the leading end of the friction reducer 25 is connected to the take-up reel 27.

Activated by the driving device 58, the take-up reel 27 rotates in the counterclockwise direction in FIG. 2, thereby winding the friction reducer 25 around the take-up reel 27 little by little. In the meantime, the supply reel 28 is rotated in the counterclockwise direction as the take-up reel 27 rotates, supplying the friction reducer 25 to the nip or to the take-up reel 28.

In this configuration, the reel mechanism 26 enables the friction reducer 25 to move from the supply reel side to the take-up reel side, thereby changing the portion of the friction reducer 25 sandwiched by the fixing belt 21 and the stationary member 22. In other words, as the take-up reel 27 rotates, portions of the friction reducer 25 that have not yet come into contact with the fixing belt 21 and the stationary member 22 are supplied by the supply reel 28 to the nip between the fixing belt 21 and the stationary member 22. Accordingly, the frictional resistance between the fixing belt 21 and the stationary member 22 is reduced.

Even when the friction reducer 25 sandwiched by the fixing belt 21 and the stationary member 22 is worn out, rotation of the reel mechanism 26 supplies the new portion of the friction reducer 25 having not been worn out between the fixing belt 21 and the stationary member 22, thereby reducing the slide resistance of the fixing belt 21 and the stationary member 22.

With the configuration described above, the sliding resistance of the fixing belt 21 and the stationary member 22 which contacts the fixing belt 21 indirectly is reduced reliably over time. This results in prevention of an increase in the drive torque of the fixing device 20 or the pressure roller 31, abrasion of the fixing device 20, the stationary member 22, and/or the friction reducer 25, and image drift on the fixed image caused by undesirable slippage of the fixing belt 21.

According to the present embodiment, the friction reducer 25 moves in the direction opposite the direction of movement of the fixing belt 21. In this configuration, even when abrasion of the friction reducer 25 and the fixing belt 21 produces undesirable dust, the dust is prevented from accumulating between the friction reducer 25 and the fixing belt 21 compared with the friction reducer 25 moving in the same direction as that of the fixing belt 21.

According to the present embodiment, the reel mechanism 26 is used as a device to move the friction reducer 25. However, the activation device is not limited to the reel mechanism 26. For example, if the total moving distance of the friction reducer does not need to be very long, the friction reducer may be an endless loop that makes one rotation during the life of the apparatus.

According to the embodiment 1, the reel mechanism 26 is configured to move the friction reducer 25 in accordance with a cumulative operation time of the fixing device 20 or the main body 1. In a case in which the friction reducer 25 is fixed between the fixing belt and the stationary member 22, abrasion of the friction reducer 25 progresses proportionately with an increase in the cumulative operation time of the fixing device 20. Thus, the reel mechanism 26 winds or moves the friction reducer 25 in accordance with the cumulative operation time of the fixing device 20 or the cumulative time of rotation of the fixing belt 21.

More specifically, in association with operation of the fixing device 20, the driving device 58 activates the reel mechanism 26 to start winding the friction reducer 25 around the take-up reel 28. At this time, the moving speed of the friction reducer 25 is significantly slower than the moving speed of the fixing belt 21, because abrasion of the friction reducer 25 sandwiched between the fixing belt 21 and the stationary member 22 does not progress very fast.

Control of the winding operation of the friction reducer 25 is not limited to that described above. Alternatively, the reel mechanism 26 or the moving mechanism may move the friction reducer 25 each time the cumulative operation time or the cumulative time of rotation of the fixing belt 21 reaches a predetermined value. More specifically, as illustrated in FIG. 2, a time detector 53 is provided to detect a cumulative operation time of the fixing device 20 or the cumulative time of rotation of the fixing belt 21.

In this configuration, when reaching the cumulative operation time detected by the time detector 53, a controller 50, which is a microprocessor, operates the reel mechanism 26 for a certain period of time which is at least a minimum time required for the friction reducer 25 to move by the nip width in the moving direction. Accordingly, the total electric power for operating the reel mechanism 26 is reduced, and the length of the friction reducer 25 in the direction of movement is reduced.

Furthermore, as illustrated in FIG. 2, a torque detector 52 may be provided to detect the drive torque of the fixing device 20. When the detection results provided by the torque detector 52 reach a predetermined value, the reel mechanism 26 starts moving the friction reducer 25.

In particular, when the drive torque detected by the torque detector 52 is at least a permissible threshold value, it is assumed that abrasion of the friction reducer 25 in the nip has progressed, and the reel mechanism 26 is activated by the controller 50 for a certain period of time which corresponds to the time required for the friction reducer 25 to move by the nip width.

Because the reel mechanism 26 is activated only under certain conditions, the total electric power for operating the reel mechanism 26 is reduced, and the length of the friction reducer 25 in the direction of movement is reduced. Furthermore, the friction reducer 25 in the nip between the fixing belt 21 and the stationary member 22 is protected from abrasion. Because the sliding resistance of the fixing belt 21 and the stationary member 22 is reduced adequately, the friction reducer 25 does not need to be moved, thereby improving control efficiency.

Furthermore, as illustrated in FIG. 2, the fixing device 20 may include a sheet counter 55 that counts the recording media sheets P passing through the nip. The number of recording media sheets P passing through the nip is also referred to as a number of prints. In this configuration, the reel mechanism 26 moves the friction reducer 25 in accordance with a cumulative number of recording media sheets counted by the sheet counter 55. The same effects as the effects provided by the time detector 53 are achieved.

When the cumulative number of recording media sheets counted by the sheet counter 55 reaches or exceeds a predetermined threshold value, it is assumed that the portion of the friction reducer 25 in the nip is worn out. Then, the controller 50 enables the reel mechanism 26 to move the friction reducer 25 for a certain period of time which is at least a minimum time required for the friction reducer 25 to move by the nip width. In this configuration, the total electric power for operating the reel mechanism 26 is reduced, and the length of the friction reducer 25 in the direction of move is shortened.

According to the present embodiment, when the friction reducer 25 between the fixing belt 21 and the stationary member 22 is not worn out and the slide resistance of the fixing belt 21 and the stationary member 22 is relatively small, the friction reducer 25 is not moved. Accordingly, control efficiency is improved.

It is to be noted that a sheet detector 56 may be provided upstream from the nip in the fixing device 20 to detect the number of recording media sheets P passing through the nip as illustrated in FIG. 2. The position of the sheet detector 56 is not limited to this. The sheet detector 56 may be disposed at a place where the recording medium passes. For example, the sheet detector 56 may be disposed near the sheet cassettes 12, 13, and 14, or near the sheet discharging portion. The sheet detector 56 may serve as the sheet counter 55.

Still further, the reel mechanism 26 may move the friction reducer 25 when the fixing member 20 is not in operation or the fixing belt 21 is not moving. More specifically, as illustrated in FIG. 2, an ON/OFF detector 54 may be provided to detect the operation of the fixing device 20.

After the ON/OFF detector 54 detects that the fixing device 20 is not in operation, the controller 50 operates the reel mechanism 26 for a certain period of time which is at least a minimum time required for the friction reducer 25 to move by the nip width. With this configuration, the total electric power for operating the reel mechanism 26 is reduced, and the length of the friction reducer 25 in the direction of movement is reduced. Furthermore, in a case in which the fixing device 20 is in operation or the fixing belt 21 is moving, the friction reducer 25 does not move so that movement of the fixing belt 21 is not affected by the friction reducer 25. For example, the fixing belt 21 is prevented from undesirable slippage and vibration, thus preventing creasing of the recording medium and an image defect.

According to the present embodiment, in order to stop reliably the friction reducer 25, a stop mechanism that adjusts movement of the friction reducer 25 may be provided to the reel mechanism 26. For example, the stop mechanism includes a brake pad that contacts or separates from the friction reducer 25.

Still alternatively, the reel mechanism 26 may be controlled to move the friction reducer 25 after the cumulative operation time of the fixing device 20 reaches the predetermined time (or the number of prints reaches the predetermined value) and when the fixing device 20 is not in operation.

In particular, when the time detector 53 detects that the cumulative operation time reached a certain value (or the number of prints counted by the counter 55 reached a certain value) and the ON/OFF detector 54 detects that the present job is finished and thus the fixing device 20 is not in operation, the controller 50 activates the reel mechanism 26 for a certain period of time.

With this configuration, the total electric power for operating the reel mechanism 26 is also reduced, and the length of the friction reducer 25 in the direction of movement is shortened. Furthermore, movement of the fixing belt 21 is not adversely affected by the friction reducer 25.

When the recording medium P is not fed in the nip (or the print operation is not performed), the reel mechanism 26 is controlled to move the friction reducer 25. As illustrated in FIG. 2, the sheet detector 56 detects the recording medium P passing through the fixing device 20 (the nip). After the sheet detector 56 detects that no recording medium passed through the nip, the controller 50 enables the reel mechanism 26 to move the friction reducer 25 for a certain period of time which is at least the minimum time required for the friction reducer 25 to move by the nip width in the moving direction.

With this configuration, the total electric power for operating the reel mechanism 26 is reduced, and the length of the friction reducer 25 in the direction of movement is reduced. Furthermore, during fixation or the image forming operation, the friction reducer 25 does not move so that movement of the fixing belt 21 is not affected by the friction reducer 25. For example, the fixing belt 21 is prevented from undesirable slippage and vibration, preventing creasing of the recording medium and an image defect.

According to the present embodiment, in order to stop reliably the friction reducer 25, the stop mechanism that adjusts movement of the friction reducer 25 may be provided to the reel mechanism 26.

Still alternatively, the reel mechanism 26 may be controlled to move the friction reducer 25 after the cumulative operation time of the fixing device 20 reaches the predetermined time (or the number of prints reaches the predetermined value) and when the recording medium P is not fed to the nip (or the fixing device 20 is not in operation).

In particular, when the time detector 53 detects that the cumulative operation time reached a certain value (or the number of prints counted by the counter 55 reached a certain value) and after the sheet detector 56 detects that no recording medium is being passed through the nip, the controller 50 activates the reel mechanism 26 for a certain period of time.

With this configuration, the total electric power for operating the reel mechanism 26 is also reduced, and the length of the friction reducer 25 in the direction of movement is shortened. Furthermore, movement of the fixing belt 21 is not adversely affected by the friction reducer 25.

According to the embodiment 1 described above, the friction reducer 25 moves such that the portion of the friction reducer 25 that comes in the nip defined by the fixing belt 21 and the stationary member 22 changes. Accordingly, the slide resistance of the fixing belt 21 and the stationary member 22 is reduced reliably over time.

According to the present embodiment, the fixing belt 21 having a multi-layered structure is employed as a fixing belt. Alternatively, an endless fixing film including polyimide, polyamide, fluorocarbon resin, and/or metal may be used as a fixing belt to provide effects equivalent to the effects provided by the foregoing embodiment.

Embodiment 2

Figure 3:
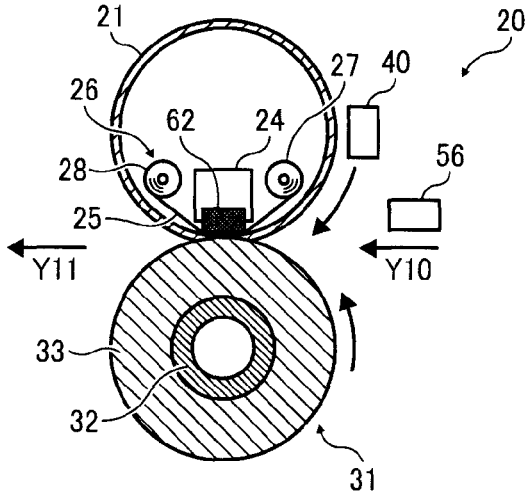
FIG. 3 is a schematic diagram illustrating the fixing device according to a second illustrative embodiment of the present invention.

Referring now to FIG. 3, a description is provided of a second illustrative embodiment of the present invention. FIG. 3 is a schematic block diagram illustrating the fixing device according to the second illustrative embodiment.

According to the present embodiment, the fixing device 20 employs a ceramic heater 62 as a heating member instead of the heater 23 in the embodiment 1.

Similar to the embodiment 1, the fixing device 20 according to the embodiment 2 includes the fixing belt 21, the holding member 24, the pressure roller 31 serving as a rotary pressing member, the friction reducer 25, the reel mechanism 26 serving as an activation device, the temperature detector 40, and so forth. The fixing device 20 of the present embodiment includes the ceramic heater 62 as a heating device that heats the fixing belt 21.

As illustrated in FIG. 3, the ceramic heater 62 is held by the holding member 24 to contact and press against the pressure roller 31 through the fixing belt 21, thereby defining the nip between the fixing belt 21 and the pressure roller 31 in which the recording medium passes. The toner image T on the recording medium P being conveyed to the nip is heated and fused by the fixing belt 21 heated by the ceramic heater 62.

In this configuration, the ceramic heater 62 serves as a heater to heat the fixing belt 21 and also as the stationary member 22 of the embodiment 1 for forming the nip.

According to the present embodiment, in the fixing device 20, the friction reducer 25 movable by the reel mechanism 26 is disposed between the fixing belt 21 and the ceramic heater 62 serving also as a stationary member. Similar to the embodiment 1, the friction reducer 25 is moved by the reel mechanism 26 such that the portion of the friction reducer 25 sandwiched between the fixing belt 21 and the ceramic heater 62 changes. Accordingly, the slide resistance of the fixing belt 21 and the ceramic heater 62 is reduced reliably over time.

Embodiment 3

Figure 4:
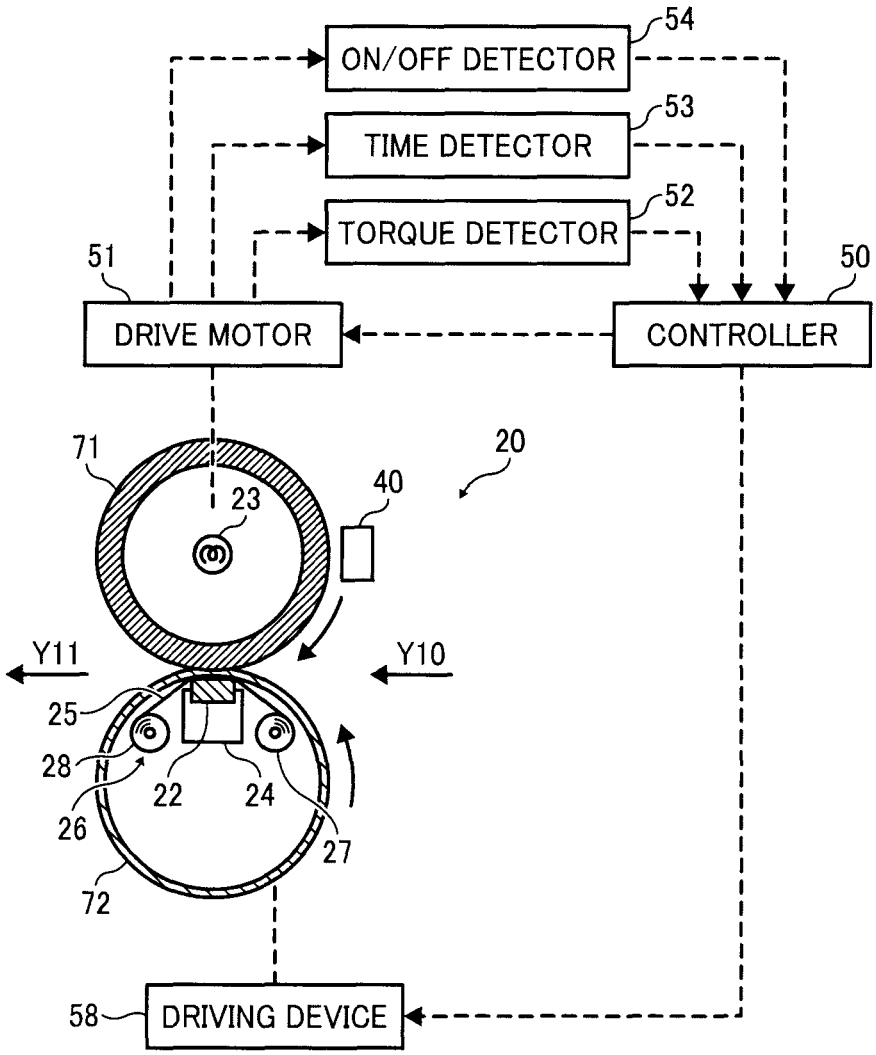
FIG. 4 is a schematic block diagram illustrating the fixing device according to a third illustrative embodiment of the present invention.

Referring now to FIG. 4, a description is provided of a third illustrative embodiment of the present invention. FIG. 4 is a schematic block diagram illustrating the fixing device according to the third illustrative embodiment.

According to the present embodiment, in the fixing device 20, a pressure belt 72 is employed as a belt member compared with the fixing belt 21 of the first illustrative embodiment.

As illustrated in FIG. 4, the fixing device 20 includes a fixing roller 71 serving as a rotary fixing member, the heater 23 serving as a heating member, the pressure belt 72 serving as a belt-type pressing member, the stationary member 22, the holding member 24, the friction reducer 25, the reel mechanism 26, the temperature detector 40, and so forth.

The fixing roller 71 includes a hollow metal core made of aluminum, iron, or the like, and an elastic layer and a releasing layer are formed sequentially on the hollow metal core. The fixing roller 71 is rotated in the clockwise direction by the drive motor 51 in FIG. 4.

Inside the fixing roller 71, the heater 23 is disposed to heat the fixing roller 71. The toner image on the recording medium P conveyed to the nip is heated and fused by the fixing roller 71 heated by the heater 25. The elastic layer and the releasing layer of the fixing roller 71 use the similar, if not the same material as that of the fixing belt 21 of the first illustrative embodiment.

The pressure belt 72 is a flexible endless belt which is moved in the direction indicated by an arrow in FIG. 4 by friction with the fixing roller 71 at the nip. The pressure belt 72 has a multi-layered structure including a base layer, an elastic layer, and a releasing layer, in that order, from the inner circumferential surface of the pressure belt 72.

The base layer of the pressure belt 72 includes, but is not limited to, metal such as nickel and stainless steel, and/or heat resistant resin such as polyimide, polyamide, and poly imide amide. The elastic layer of the pressure belt 72 includes, but is not limited to, rubber material such as silicon rubber, silicon rubber foam, and/or fluorocarbon rubber. The releasing layer of the pressure belt 72 includes, but is not limited to, PFA, PTFE, polyimide, polyetherimide, and/or polyether sulfide (PES).

In the inner loop of the pressure belt 72, the stationary member 22, the holding member 24, the friction reducer 25, the reel mechanism 26, and so forth are disposed. The pressure belt 72 is pressed by the stationary member 22 held by the holding member 24, thereby defining the nip together with the fixing roller 71. Because the friction reducer 25 in the pressure belt 72 and the reel mechanism 26 have a configuration similar to that of the foregoing embodiments described above, the description thereof is omitted.

According to the third illustrative embodiment, the reel mechanism 26 moves the friction reducer 25 disposed between the pressure belt 72 and the stationary member 22. The reel mechanism 26 is operated in the similar, if not the same manner as the first illustrative embodiment. Thus, the detail description thereof is omitted.

According to the third illustrative embodiment, the friction reducer 25 is moved such that the portion of the friction reducer 25 sandwiched between the pressure belt 72 and the stationary member 22 changes. Accordingly, the slide resistance between the pressure belt 72 and the stationary member 22 is reduced reliably over time.

According to the foregoing embodiments, the present invention is applied to the fixing device 20 of the monochrome image forming apparatus. However, the present invention may be applied to a fixing device employed in a color image forming apparatus.

According to the foregoing embodiments, the heater 23 and the ceramic heater 62 are employed as a heating device that heats the belt-type fixing member (the fixing belt 21) and the roller-type fixing member (the fixing roller 71). Alternatively, other heating devices, for example, an electromagnetic induction heating device, may be employed to heat the fixing belt 21 or the fixing roller 71, to provide the same effects as the effects provided by the heater 23 and the ceramic heater 62.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

an endless belt-shaped fixing member formed in a loop, to move in a predetermined direction and fix a toner image on a recording medium by heating and fusing the toner image;

a rotary pressing member disposed opposite the fixing member;

a stationary member provided inside the loop formed by the fixing member and pressed against the rotary pressing member through the fixing member to form a nip between the rotary pressing member and the fixing member through which the recording medium bearing the toner image passes;

a friction reducer disposed between the fixing member and the stationary member, to reduce friction generated therebetween;

an activation device provided inside the loop of the fixing member, to move the friction reducer to change a portion of the friction reducer that comes between the fixing member and the stationary member; and a torque detector to detect a drive torque of the fixing device, wherein the activation device moves the friction reducer every time a result of detection provided by the torque detector reaches a predetermined value.

2. A fixing device, comprising:

an endless belt-shaped fixing member formed in a loop, to move in a predetermined direction and fix a toner image on a recording medium by heating and fusing the toner image;

a rotary pressing member disposed opposite the fixing member;

a stationary member provided inside the loop formed by the fixing member and pressed against the rotary pressing member through the fixing member to form a nip between the rotary pressing member and the fixing member through which the recording medium bearing the toner image passes;

a friction reducer disposed between the fixing member and the stationary member, to reduce friction generated therebetween; and an activation device provided inside the loop of the fixing member, to move the friction reducer to change a portion of the friction reducer that comes between the fixing member and the stationary member, wherein the activation device moves the friction reducer when the fixing device is not in operation.

3. The fixing device according to claim 2, further comprising a cumulative operation time detector, wherein the activation device moves the friction reducer every time a cumulative operation time of the fixing device detected by the cumulative operation time detector reaches certain levels.

4. The fixing device according to claim 2 further comprising a sheet detector, wherein the activation device moves the friction reducer in accordance with an increase in a cumulative number of recording media sheets passing through the nip as detected by the sheet detector.

5. The fixing device according to claim 2, further comprising a sheet detector, wherein the activation device moves the friction reducer every time a cumulative number of recording media sheets detected by the sheet detector reaches a certain number of sheets.

6. The fixing device according to claim 2, further comprising a cumulative operation time detector, wherein the activation device moves the friction reducer in accordance with an increase in a cumulative operation time of the fixing device as detected by the cumulative operation time detector.

7. The fixing device according to claim 1, wherein the activation device moves the friction reducer when the recording medium is not fed to the nip.

8. The fixing device according to claim 1, wherein the activation device comprises a reel mechanism, wherein the friction reducer includes a flexible sliding web-like member, and the reel mechanism changes a portion of the friction reducer that comes between the fixing member and the stationary member.

9. The fixing device according to claim 8, wherein the reel mechanism comprises a supply reel and a take-up reel, wherein the web-like member is stretched between the supply reel and the take-up reel, and the friction reducer is unwound from the supply reel and wound around the take-up reel.

10. The fixing device according to claim 8, wherein the web-like member includes at least one of a heat-resistant resin nonwoven fabric, a heat-resistant resin film, a liquid crystal polymer sheet, a liquid crystal polymer film, a porous resin nonwoven fabric, a porous resin film, and fiberglass.

11. A fixing device, comprising:

a rotary fixing member to heat and fuse a toner image onto a recording medium to fix the toner image thereon;

an endless belt-shaped pressure member disposed opposite the fixing member, formed in a loop to move in a predetermined direction;

a stationary member provided inside the loop formed by the pressure member and pressed against the rotary fixing member through the pressure member to form a nip between the pressure member and the rotary fixing member through which the recording medium bearing the toner image passes;

a friction reducer sandwiched between the pressure member and the stationary member, to reduce friction generated therebetween;

an activation device to move the friction reducer to change a portion of the friction reducer that comes between the pressure belt and the stationary member; and a torque detector to detect a drive torque of the fixing device, wherein the activation device moves the friction reducer every time a result of detection provided by the torque detector reaches a predetermined value.

12. An image forming apparatus comprising the fixing device of claim 1.

13. The fixing device according to claim 2, wherein the activation device moves the friction reducer when the recording medium is not fed to the nip.

14. The fixing device according to claim 2, wherein the activation device comprises a reel mechanism, wherein the friction reducer includes a flexible sliding web-like member, and the reel mechanism changes a portion of the friction reducer that comes between the fixing member and the stationary member.

15. The fixing device according to claim 14, wherein the reel mechanism comprises a supply reel and a take-up reel, wherein the web-like member is stretched between the supply reel and the take-up reel, and the friction reducer is unwound from the supply reel and wound around the take-up reel.

16. The fixing device according to claim 14, wherein the web-like member includes at least one of a heat-resistant resin nonwoven fabric, a heat-resistant resin film, a liquid crystal polymer sheet, a liquid crystal polymer film, a porous resin nonwoven fabric, a porous resin film, and fiberglass.

17. An image forming apparatus comprising the fixing device of claim 2.

18. The fixing device according to claim 2, wherein the activation device moves the friction reducer in a direction opposite to the predetermined direction.

19. A fixing device, comprising:

a rotary fixing member to heat and fuse a toner image onto a recording medium to fix the toner image thereon;

an endless belt-shaped pressure member disposed opposite the fixing member, formed in a loop to move in a predetermined direction;

a stationary member provided inside the loop formed by the pressure member and pressed against the rotary fixing member through the pressure member to form a nip between the pressure member and the rotary fixing member through which the recording medium bearing the toner image passes;

a friction reducer sandwiched between the pressure member and the stationary member, to reduce friction generated therebetween; and an activation device to move the friction reducer to change a portion of the friction reducer that comes between the pressure belt and the stationary member;

wherein the activation device moves the friction reducer when the fixing device is not in operation.

* * * * *